US007837809B2

(12) United States Patent
Ferruelo Nicolas et al.

(10) Patent No.: US 7,837,809 B2
(45) Date of Patent: Nov. 23, 2010

(54) MATERIALS FOR THE PRODUCTION OF ECOLOGICAL AMMUNITION AND OTHER APPLICATIONS

(75) Inventors: Eva Maria Ferruelo Nicolas, Madrid (ES); Maria Del Pilar Hierro Bengoa, Madrid (ES); Francisco Javier Perez Trujillo, Madrid (ES); Manuel Ruiz Bowen, Madrid (ES); Juan Antonio Trilleros Villaverde, Madrid (ES); Isabel Lasanta Carrasco, Madrid (ES)

(73) Assignee: Real Federacion Espanola De Caza, Madrid (ES)

( * ) Notice: Subject to any disclaimer, the term of this patent is extended or adjusted under 35 U.S.C. 154(b) by 744 days.

(21) Appl. No.: 11/199,808

(22) Filed: Aug. 9, 2005

(65) Prior Publication Data

US 2007/0017408 A1 Jan. 25, 2007

(30) Foreign Application Priority Data

Aug. 10, 2004 (ES) ..... 200402002

(51) Int. Cl.
*C22C 18/00* (2006.01)

(52) U.S. Cl. ..... 148/441; 75/232

(58) Field of Classification Search ..... 419/47; 148/441

See application file for complete search history.

(56) References Cited

U.S. PATENT DOCUMENTS

| | | | | |
|---|---|---|---|---|
| 4,949,644 | A | 8/1990 | Brown | |
| 4,949,645 | A | 8/1990 | Hayward et al. | |
| 5,264,022 | A | 11/1993 | Haygarth et al. | |
| 5,279,787 | A * | 1/1994 | Oltrogge | 419/38 |
| 5,527,376 | A | 6/1996 | Amick et al. | |
| 5,713,981 | A | 2/1998 | Amick | |
| 5,877,437 | A | 3/1999 | Oltrogge | |
| 5,946,849 | A | 9/1999 | Brown | |
| 5,950,064 | A * | 9/1999 | Robinson et al. | 419/47 |
| 6,149,705 | A | 11/2000 | Lowden et al. | |
| 6,325,136 | B1 | 12/2001 | Ratte et al. | |
| 6,536,352 | B1 | 3/2003 | Nadkarni et al. | |
| 6,569,381 | B2 | 5/2003 | Le Floc'h et al. | |
| 2001/0053331 | A1 | 12/2001 | Le Floc'h et al. | |

(Continued)

FOREIGN PATENT DOCUMENTS

| | | |
|---|---|---|
| CA | 2 380 704 | 9/2003 |

(Continued)

*Primary Examiner*—George Wyszomierski
*Assistant Examiner*—Weiping Zhu
(74) *Attorney, Agent, or Firm*—Katten Muchin Rosenman LLP

(57) ABSTRACT

The present invention provides an ODS type material (Oxide dispersion strengthened or particle dispersion) which comprises an alloy metal matrix and a dispersion of strengthening particles distributed therein which provide the same with optimum density and deformability. Said metal matrix is constituted by an alloy of zinc and bismuth, of zinc and aluminium, of tin and bismuth, or of tin and zinc, the strengthening material being of tungsten or ferro tungsten, oxides of both, carbides of both, or derivatives of the same. Said new material can substitute for lead in the production of ecological ammunition, hooks for fishing, inertial counterweights in automobiles, X-rays and ionising radiation screens, golf sticks, water pipes and plumbing fittings, as well as in electrical and magnetic applications. The invention also provides an ecological ammunition manufactured from said composite material, such as, for example, pellets.

13 Claims, 1 Drawing Sheet

U.S. PATENT DOCUMENTS

2004/0055205 A1 3/2004 Pack

FOREIGN PATENT DOCUMENTS

| | | |
|---|---|---|
| EP | 1 154 026 | 11/2001 |
| EP | 1 457 578 | 9/2004 |
| GB | 2 211 920 | 7/1989 |
| GB | 2 327 113 | 1/1999 |
| WO | 01/59399 | 8/2001 |

* cited by examiner

MATERIALS FOR THE PRODUCTION OF ECOLOGICAL AMMUNITION AND OTHER APPLICATIONS

FIELD OF THE INVENTION

The present invention relates to new ecological materials of the type ODS (Oxide dispersion strengthened or with particle dispersion) which comprise a metal alloy matrix in which a dispersion of strengthening particles is distributed, and which have optimum values of density and deformability for their use as ecological ammunition, in hunting activities, hooks, for their use in fishing, inertial counterweights in automobiles, X-rays and ionising radiation screens, golf sticks, water pipes and plumbing fittings and electrical and magnetic applications.

BACKGROUND OF THE INVENTION

Lead pellets are used conventionally in hunting activities. Density is the characteristic which confers lead pellet with its excellent mechanical and ballistic properties. This characteristic is what makes it very difficult to obtain new materials for the manufacture of pellets suitable for said hunting activities.

However, the high toxicity of lead, which signifies a steady impairment of the environment, especially in wetlands, as well as the poisoning of a great number of animal species, has created the need to develop multiple solutions to palliate this serious problem.

One of the substitutes for lead is steel and, in fact, ammunition is marketed based on this material. However it has serious drawbacks among which are its low density and its greater hardness with respect to lead, which necessarily implies a larger quantity of explosive, limiting, thereby, the weapon that can be used.

In the American patent U.S. Pat. No. 4,949,644 the development is described of bismuth shot pellets. Said material has a density which is higher than that of steel but less than that of lead. Together with this problem, bismuth is a very brittle material, (mechanical property) which results in the fracture and disintegration of the pellet on impact.

In the American patents U.S. Pat. Nos. 5,264,022, 5,527,376 and 5,713,981 the development is described of shot pellets containing a binary alloy of iron and tungsten in different proportions (with a percentage of tungsten of 30-46%, of 40-60%, or of 30-65%). The main drawback of this material is its great hardness, which results in damage to the barrel of the weapon every time a shot is fired.

In the American patent U.S. Pat. No. 4,949,645 the development is described of pellets formed by tungsten and a powdered polymer (polyethylene or silicone rubber, for example). The problem with this material resides in that the projectile has no penetration because the kinetic energy is absorbed and dissipated in its own deformation.

In the American patent U.S. Pat. No. 6,149,705, the development is described of pellets comprising a core of tungsten carbide powder, which can also contain elements like tungsten or tantalum, coated with metals such as aluminium, bismuth, copper, tin or zinc. However, said ammunition has the drawback of over-hardness of the tungsten carbide core for which reason, on striking the objective of the hunt, it produces a perforation of the animal with egress of the ammunition.

In the document GB 2211920, the development is described of pellets consisting of zinc-aluminium or zinc-tin alloys, with possible additions of other metals like copper, magnesium, silicon, alkaline or alkaline-earth metals. Said pellets, however, have a low density with respect to that of lead, which can result in having to change the weapon.

In the document GB 2327113 A, the development is described of pellets consisting of a tin-bismuth alloy, preferably in the proportion of the eutectic point (45% Bi and 55% Sn), which also has drawbacks regarding its density and hardness.

In the patent U.S. Pat. No. 5,877,437 a procedure is described for obtaining projectiles from a composite material which comprises a metal matrix and metal particles. This type of material presents problems on impact.

In the patent WO01/59399 a procedure is defined for obtaining bullets and projectiles based on a material which comprises a conglomerate of metal and/or alloy particles which are compacted by a powered-metal system. The main drawback of this method resides in the characteristics of the type of material which imply the need to use high melting temperatures and pressures to be able to mould and obtain the final projectiles and bullets.

In the patent U.S. Pat. No. 6,536,352, a procedure is described for obtaining bullets from a material which comprises a matrix of metal particles bonded by a metal of low melting point to obtaining a powdered-metal product. The characteristics of this material require the use of high compacting pressures, for shaping and obtaining of the end product.

In the patent EP1457578 an ecological ammunition is described formed by a material of the powdered-metal type which comprises spherical particles of tungsten absorbed in a tin matrix and a method of production of said materials based on the application of pressures below 250 MPa. The employment of said pressures signifies a high additional expense.

However, in spite of the current developments, there continues to exist in the state of the art, the need to provide new alternative materials to lead for manufacturing ecological ammunition intended for hunting activities. Said materials must have an optimum density proximate to that of lead as well as ballistic and mechanical properties similar to those currently available with lead in order, on one hand, to prevent the impairment of the environment and, on the other, avoid modification to the design of the current cartridges and the explosive which is used for lead pellets.

Within these possibilities, are found materials of the ODS (oxide dispersion strengthened or particle dispersion) type, where particles with different degrees of oxidation are introduced in a metal alloy matrix, in such a way that they reduce the interfacial energy between particles and matrix. Thus, the unit maintains its mechanical characteristics, and its deformability without disintegrating on impact. This means they have advantages over composite materials, like that of the Patent U.S. Pat. No. 5,877,437, with regard to impact.

On the other hand, there are presently several types of fishing weights on the market, although that which is used most frequently and, is therefore the most common, is the lead weight. In contact with water lead gradually releases certain quantities of toxins into the medium as a function of the concentration or the levels of nitrates, chlorines and oxygen which the water contains.

Bacteria and toxins build up in the contaminated sediments degrading the quality of the water which is home to crabs, oysters, shrimps, shellfish and all types of fish, making them unfit for human consumption.

As an alternative to the use of lead, weights are to be found based on tin and bismuth, among others.

In the Canadian patent CA 2380704, reference is made to the manufacture of fishing weights based on tin alloys, plus other metals in smaller proportions like silver, copper, antimony, zinc, nickel, which alloys are not corrosive when exposed to seawater, and therefore do not contaminate the environment.

In the European patent EP 1154026, use is made of elements composed of tin-tungsten as substitutes for lead.

In the American patent US 2004/0055205, reference is made to the production of fishing jigs, the base material of which is tungsten carbide in the greater part in addition to other minority elements like cobalt, titanium carbide, tantalum or niobium carbide and traces of vanadium carbide, chromium carbide and nickel.

In the American patent U.S. Pat. No. 6,325,136, reference is made to the production of fishing weights from alloys based on bismuth in a proportion by weight of more than 48% and tin.

In the American patent U.S. Pat. No. 5,946,849, reference is made to the production of fishing jigs using bismuth alloys as base material with a percentage of bismuth by weight which varies between 50-98% and small additions of tin, antimony and zinc or mixtures of these.

Surprisingly, the present inventors have discovered a new ecological material of the ODS type, with particle dispersion, with a density which allows it to replace lead in the whole range of ballistic and mechanical properties, but without its toxic effects. The ammunition fabricated from this material has good properties relative to the range and the transmission of kinetic energy on impact thanks to its optimum deformability, thereby overcoming the drawbacks of the alternative materials to lead being used at the present time.

Said material is based on a metal alloy matrix in which strengthening particles are dispersed, the metal matrix consisting of an alloy of zinc and bismuth, of zinc and aluminium, of tin and bismuth or of tin and zinc, and optionally other materials of low melting temperature, and the strengthening particles being tungsten or ferro tungsten particles; it being possible also to reinforce the matrix with particles of tungsten or ferro tungsten oxides or carbides, or any compound of these.

The composition of this new material contributes to increasing the density of the alloy without affecting its mechanical properties of hardness, malleability, deformability, inertia, etc., and also provides it with ecological properties which permit its employment in different applications without contaminating the environment.

Thus, this material finds application in other such activities as the manufacture of fishhooks for game fishing, of inertial counterweights in automobiles, of X-rays and ionising radiation screens, of golf sticks, as well as in water pipes and plumbing fittings and in electrical and magnetic applications, overcoming the drawbacks arising from the use of lead.

OBJECT OF THE INVENTION

Figure 1:
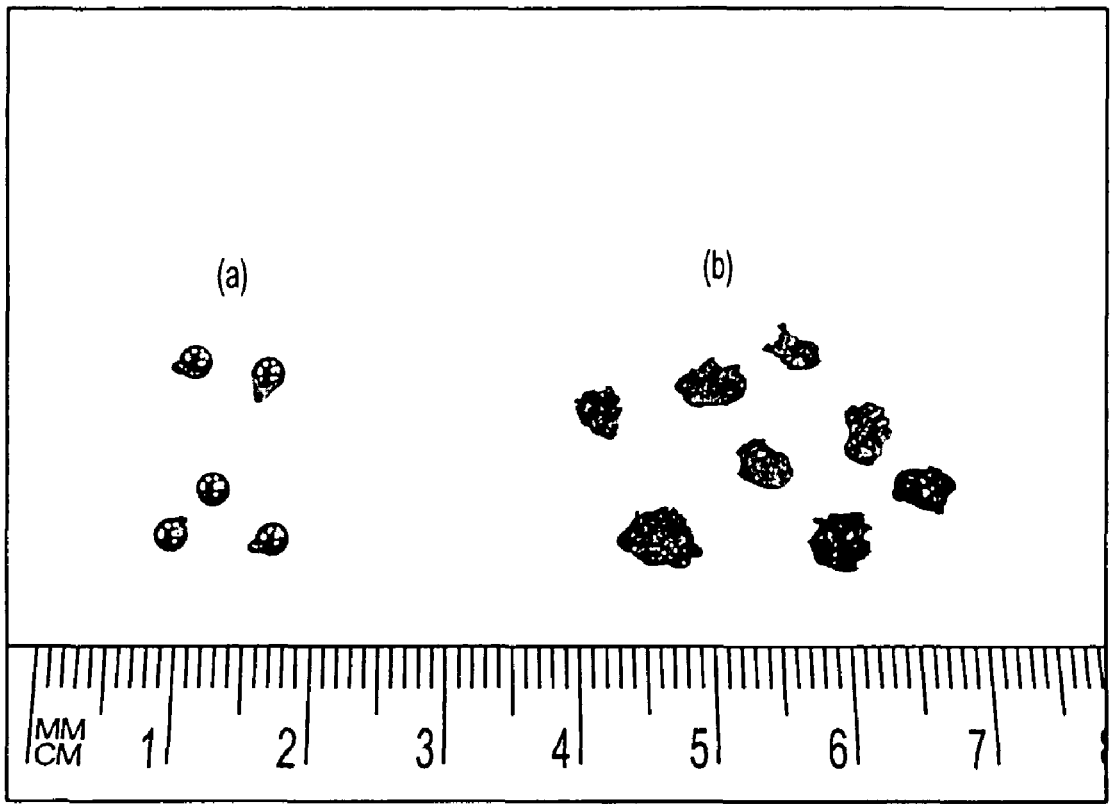
FIG. 1. Degree of deformability of impact upon a steel plate at a distance of 20 m of a pellet obtained from a tin-bismuth alloy with 22% of pre-oxidised ferro tungsten as strengthening particle; (a) un-shot pellets, (b) shot pellets.

Therefore the object of the present invention is to provide a new ODS type ecological material which comprises a metal alloy matrix and a dispersion of strengthening particles distributed therein, with a density which would vary between 7 and 14 g/cm$^3$ and an optimum deformability greater than or equal to 10%.

A further object of the invention is the employ of this new material for the production of ecological ammunition, hooks for fishing, inertial counterweights in automobiles, X-rays and ionising radiation screens, golf sticks, as well as in water pipes and plumbing fittings and electrical and magnetic applications.

Finally, another object of the invention is the ecological ammunition manufactured from said ODS type material.

DETAILED DESCRIPTION OF THE INVENTION

The present invention provides a new ODS type ecological material which comprises a metal alloy matrix and a dispersion of strengthening particles distributed therein, with a density which varies between 7 and 14 g/cm$^3$ and an optimum deformability greater than or equal to 10%.

In a particular embodiment of the new material object of the invention, the metal matrix is constituted by an alloy of zinc and bismuth, of zinc and aluminium, of tin and bismuth or of tin and zinc.

In a preferred embodiment, the metal matrix is constituted by an alloy of zinc and bismuth with 1-29% of bismuth by weight and 71-99% of zinc by weight, or an alloy of zinc and aluminium with 75-95% of zinc by weight and 5-25% of aluminium by weight; or a bismuth and tin alloy with 71-99% of bismuth by weight and 1-29% of tin by weight; or an alloy of zinc and tin with 1-39% of tin by weight and 61-99% of zinc by weight, in this case without strengthening, or an alloy of zinc and tin with 1-99% of zinc by weight and 99-1% of tin by weight, being in this case with strengthening, percentages by weight with respect to the total weight of alloy.

In another particular embodiment of the invention the strengthening particles are particles of tungsten, ferro tungsten, tungsten carbide, ferro tungsten carbide, tungsten oxide, ferro tungsten oxide or derivatives of these.

It has been demonstrated that the incorporation of the dispersion of tungsten or ferro tungsten particles which have been subjected to total or partial oxidation prior to their addition to the metal matrix, also allows an appropriate ODS type material to be obtained to manufacture ecological ammunition alternative to that based on lead.

In a particular embodiment of the invention, the strengthening particles have a diameter of between 1-500 μm.

In another particular embodiment of the material of the invention, the proportion between the metal matrix and the dispersion of strengthening particles varies between 0 and 0.8.

In a preferred embodiment, the proportion between the metal matrix and the particles of the dispersion is the following:

- matrix of zinc and bismuth alloy/tungsten particles=0-0.734,
- matrix of zinc and bismuth alloy/ferro tungsten particles=0-0.510
- matrix of zinc and aluminium alloy/tungsten particles=0-0.775
- matrix of zinc and aluminium alloy/ferro tungsten particles=0-0.539
- matrix of bismuth and tin alloy/tungsten particles=0-0.597
- matrix of bismuth and tin alloy/ferro tungsten particles=0-0.414
- matrix of tin and zinc alloy/tungsten particles=0-0.720
- matrix of tin and zinc alloy/ferro tungsten particles=0-0.500
- matrix of zinc and bismuth alloy/particles of tungsten oxide=0-0.634, matrix of zinc and bismuth alloy/particles of ferro tungsten oxide=0-0.550 matrix of zinc and aluminium alloy/particles of tungsten oxide=0-0.775 matrix of zinc and aluminium alloy/particles of ferro tungsten oxide=0-0.560 matrix of bismuth and tin alloy/particles of tungsten oxide=0-0.650 matrix of bismuth and tin alloy/particles of ferro tungsten oxide=0-0.430 matrix of tin and zinc alloy/particles of tungsten oxide=0-0.720 matrix of tin and zinc alloy/particles of ferro tungsten oxide=0-0.520 matrix of zinc and bismuth alloy/particles of tungsten carbide=0-0.710, matrix of zinc and bismuth alloy/particles of ferro tungsten carbide=0-0.550 matrix of zinc and aluminium alloy/particles of tungsten carbide=0-0.710 matrix of zinc and aluminium alloy/particles of ferro tungsten carbide=0-0.560 matrix of bismuth and tin alloy/particles of tungsten carbide=0-0.610 matrix of bismuth and tin alloy/particles of ferro tungsten carbide=0-0.420 matrix of tin and zinc alloy/particles of tungsten carbide=0-0.740 matrix of tin and zinc alloy/particles of ferro tungsten carbide=0-0.520.

The incorporation of the strengthening particles allows a new material to be obtained with optimum values of density and with mechanical and hunting properties similar to those of lead, since they contribute to increasing the density of the alloy without affecting its hardness, malleability, ballistics, etc. In addition, has good properties relative to the range and the transmission of the kinetic energy during the impact thanks to its good deformability, which avoids its disintegration on said impact.

Thus, in a particular embodiment of the invention, using the tin-bismuth alloy with 22% of pre-oxidised ferro tungsten as strengthening particle, it is possible to obtain densities greater than those of lead, of the order of 10.2 g/cm$^3$. In addition the properties of deformability on impact are improved (FIG. 1).

In addition, the new ODS type material of the invention can comprise a metal selected among antimony, tin, copper, zinc and iron.

The employment of said metals allows the properties of the new material of the present invention to be enhanced and optimised in the production of, for example, ecological ammunition, particularly pellets, in comparison with lead pellets.

In a particular embodiment, the new material of the invention comprises said metal in a proportion from 0.05 to 10% by weight with respect to the total weight of metal alloy.

In a preferred embodiment, the new material of the invention comprises antimony in a proportion of 0.1-6% by weight with respect to the total weight of metal alloy.

In another preferred embodiment, the new material of the invention comprises tin in a proportion of 0.1-5% by weight with respect to the total weight of metal alloy.

In another preferred embodiment, the new material of the invention comprises copper in a proportion of 0.1-2% by weight with respect to the total weight of metal alloy.

In another preferred embodiment, the new material of the invention comprises zinc in a proportion of 0.1-5% by weight with respect to the total weight of metal alloy.

In another preferred embodiment, the new material of the invention comprises iron in a proportion of 0.1-5% by weight with respect to the total weight of metal alloy.

Said ecological material, through the characteristics of its composition, does not harm the environment, presenting a high resistance to chemical corrosion in contact with water, which, together with its mechanical properties of hardness, malleability, deformability, etc., allows it to be employed in different applications.

Thus, in another aspect of the invention, the employment of this new material is envisioned in the production of ecological ammunition, hooks for fishing, inertial counterweights in automobiles, X-rays and ionising radiation screens, golf sticks, water pipes and plumbing fittings and electrical and magnetic applications.

In the context of the present application, the term "ammunition" includes any type of ammunition which can be used in weapons intended for hunting activities such as, for example, pellets, bullets, buckshots, slugs, etc.

In preferred embodiments of the invention, the ecological ammunition, manufactured from this new material, is a pellet.

Lastly, in another aspect of the invention, the present application provides an ecological ammunition, preferably a pellet, manufactured from the material, type ODS, described above.

In a preferred embodiment, said pellet has magnetic properties. This is the case of pellets manufactured with an ODS type material in which the metal strengthening dispersion is made of ferro tungsten. Said pellets are particularly advantageous as regards their localization and collection in the hunting area where they have been used by means of the employment of an appropriate device which incorporates, for example, a magnet.

The sizes of the pellets which can be manufactured using the new material with particle dispersion, includes the sizes of the lead pellets marketed and any other which requires to be adjusted to the ballistic properties for the different types of weapons. In general, the sizes and forms of the pellets manufactured will depend on the projectile and on the weapon which it is desired to use.

The new material allows mechanical and ballistic properties to be obtained similar to those of lead, at lower densities than those of this chemical element and its alloys used in hunting ammunition. These properties of the internal and external ballistics mean it is unnecessary to make modifications in the design of current firearms. In addition, the density of the material allows the employment of atmospheric, or very reduced pressures, as well as low melting temperatures for their production, which signifies a substantial saving from the energy point of view.

The invention claimed is:

1. An ODS type ecological material comprising:

a metal alloy matrix comprising a metal alloy and a dispersion of strengthening particles distributed therein;

a density between 7-14 g/cm3; and a deformability greater than or equal to 10%, wherein the metal alloy matrix lacks structural porosity.

2. ODS type ecological material, according to claim 1, characterized in that the alloy is selected from an alloy of zinc and bismuth, of zinc and aluminium, of tin and bismuth or of tin and zinc.

3. ODS type ecological material according to claim 2, characterized in that the metal alloy is constituted by an alloy of zinc and bismuth with 1-29% of bismuth by weight and 71-99% of zinc by weight; or an alloy of zinc and aluminium with 75-95% of zinc by weight and 5-25% of aluminium by weight; or a bismuth and tin alloy with 71-99% of bismuth by weight and 1-29% of tin by weight; or an alloy of zinc and tin with 1-39% of tin by weight and 61-99% of zinc by weight, in this case without strengthening, or an alloy of zinc and tin with 1-99% of zinc by weight and 99-1% of tin by weight, being in this case with strengthening, percentages by weight with respect to the total weight of alloy.

4. ODS type ecological material according to claim 1, characterized in that the strengthening particles are of tungsten, ferro tungsten, tungsten carbide, ferro tungsten carbide, tungsten oxide, ferro tungsten oxide or derivatives of these.

5. ODS type ecological material according to claim 4, characterized in that the strengthening particles have a diameter of between 1-500 μm.

6. ODS type ecological material, according to claim 1, characterized in that the proportion by weight between the metal alloy matrix and the strengthening particles varies between 0 and 0.8.

7. ODS type ecological material according to claim 6, characterized in that the material comprises one of the following combinations of metal matrices and strengthening particles in the following proportions by weight matrix of zinc and bismuth alloy/tungsten particles=0-0.734 matrix of zinc and bismuth alloy/ferro tungsten particles=0-0.510 matrix of zinc and aluminium alloy/tungsten particles=0-0.775 matrix of zinc and aluminium alloy/ferro tungsten particles=0-0.539 matrix of bismuth and tin alloy/tungsten particles=0-0.597 matrix of bismuth and tin alloy/ferro tungsten particles=0-0.414 matrix of tin and zinc alloy/tungsten particles=0-0.720 matrix of tin and zinc alloy/ferro tungsten particles=0-0.500 matrix of zinc and bismuth alloy/tungsten oxide particles=0-0.634, matrix of zinc and bismuth alloy/ferro tungsten oxide particles=0-0.550 matrix of zinc and aluminium alloy/tungsten oxide particles=0-0.775 matrix of zinc and aluminium alloy/ferro tungsten oxide particles=0-0.560 matrix of bismuth and tin alloy/tungsten oxide particles=0-0.650 matrix of bismuth and tin alloy/ferro tungsten oxide particles=0-0.430 matrix of tin and zinc alloy/tungsten oxide particles=0-0.720 matrix of tin and zinc alloy/ferro tungsten oxide particles=0-0.520 matrix of zinc and bismuth alloy/tungsten carbide particles=0-0.710.

matrix of zinc and bismuth alloy/ferro tungsten carbide particles=0-0.550 matrix of zinc and aluminium alloy/tungsten carbide particles=0-0.710 matrix of zinc and aluminium alloy/ferro tungsten carbide particles=0-0.560 matrix of bismuth and tin alloy/tungsten carbide particles=0-0.610 matrix of bismuth and tin alloy/ferro tungsten carbide particles=0-0.420 matrix of tin and zinc alloy/tungsten carbide particles=0-0.740 matrix of tin and zinc alloy/ferro tungsten carbide particles=0-0.520.

8. ODS type ecological material according to claim 1, characterized in that it comprises a metal selected among antimony, tin, copper, zinc and iron.

9. ODS type ecological material according to claim 8, characterized in that it comprises said metal in a proportion from 0.05 to 10% by weight with respect to the total weight of metal alloy.

10. ODS type ecological material according to claim 9, characterized in that it comprises iron in a proportion of 0.1-5% by weight with respect to the total weight of metal alloy.

11. ODS type ecological material according to claim 1, wherein the material is used as one of ecological ammunition, hooks for fishing, inertial counterweights in automobiles, X-rays and ionising radiation screens, golf sticks, water pipes and plumbing fittings, and electrical and magnetic applications.

12. ODS type ecological material according to claim 11, wherein the ecological ammunition is a pellet.

13. An ODS type ecological material comprising:

a metal alloy matrix comprising (a) a two-part alloy of zinc and bismuth, zinc and aluminium, tin and bismuth, or tin and zinc, and (b) a dispersion of strengthening particles distributed in the two-part alloy, the dispersion made of tungsten, ferrotungsten, tungsten carbide, ferrotungsten carbide, tungsten oxide, ferrotungsten oxide or derivatives thereof, the metal alloy matrix comprising a density between 7-14 g/cm3, a deformability greater than or equal to 10% and a proportion of the metal alloy matrix and the strengthening particles varying between 0 and 0.8;

wherein the metal alloy matrix lacks structural porosity.

* * * * *